VENEER LATHE WITH CORD EMBEDDING KNIFE

BACKGROUND OF THE INVENTION

The present invention relates to a veneer lathe having a knife for cutting a log into a veneer sheet and at least one second knife which is located on rake face side of the veneer cutting knife and adapted to form a cut or slit in the periphery of the log while embedding a cord in the slit.

Various veneer lathes of the type described have heretofore been proposed in connection with Japanese Patent Publication No. 35-4246 entitled "Improvement in Method of Preventing Damage to Veneer Sheet in Plywood Production", Japanese Patent Publication No. 39-14994 entitled "Apparatus for Reinforcement of Veneer Sheet", Japanese Patent Publication No. 49-6642 entitled "Apparatus Associated with Rotary Veneer Lathe for Burying Cord in Trimmed Edge of Log", Japanese Patent Publication No. 49-35052 entitled "Veneer Sheet Processing Method", etc. All of these known types of veneer lathes with cord embedding knives have failed, however, to achieve a systematic combination of the cord embedding knife and the veneer lathe alloted with different functions: the cord embedding knife serving to embed a cord in a log and the veneer lathe serving to cut a veneer sheet from a log.

A typical example of a prior art veneer lathe having a cord embedding knife is illustrated in FIG. 1. The cord embedding knife denoted by the reference numeral 4 is so constructed and arranged to form a cut or slit in the periphery of a turning log 2 while embedding a string or cord 3 in the slit. The log 2 reinforced by the cord 3 is cut into a veneer sheet 1 by a usual veneer cutting knife 6 which is rigidly mounted on a tool rest 7 of the veneer lathe. FIG. 2 is an enlarged sectional side view of the veneer sheet 1 turned from the cord embedded log 2. It will be observed in FIG. 2 that the cord 3 in the slit 5 of the veneer sheet 1 has locally lifted itself away from the bottom of the slit.

This undesirable phenomenon is attributable to a tension which will be discussed with reference also to FIG. 3. When the veneer sheet 1 is cut from the log 2 by the knife 6, it moves outward away from the log at a high speed and at an angle to the log which corresponds to the angle of the cutting edge of the knife 6. This results in an abrupt and intense force which pulls the cord 3 so that the cord 3 is displaced from its normal position A to an abnormal position B rising from the bottom of the slit 5. Such a displacement of the cord 3 will also be invited by any other condition which would exert a pulling force on the veneer sheet 1 during travel of the veneer sheet out of the veneer lathe. Particularly, the pulling force or tension acts in a concentrated manner on the cord 3 every time a defective portion of the veneer sheet is moved past the veneer cutting knife 6. For this reason, the cord 3 rises away from the bottom of the slit at those portions of the veneer sheet which define the rear edges of the defects with respect to the moving direction of the veneer sheet as illustrated in FIG. 2, in which the defects are represented by a lost portion 8 caused by a crack and a lost portion 9 caused by a peripheral recessed part of the log. Naturally, a loose portion of the veneer sheet, if not completely lost, brings about a similar tension exerted in a concentrated manner on part of the cord bridging the defect 8 or 9 mentioned. In this way, the conventional veneer lathe with a cord embedding knife prevents the cord from reinforcing those portions of a veneer sheet which need reinforcement most acutely, due to its very characteristics. This constitutes a critical problem in the practical use of the veneer lathe. To solve this problem, the invention disclosed in Japanese Patent Application Post-Examination Publication No. 51-31559 introduced a veneer lathe in which a similar cord embedding knife works on a veneer sheet immediately after being cut from the log to ensure that the cord buried in a cut formed in the veneer sheet will not be subjected to any external force as observed at the moment of separation from the log. However, this prior art creates another problem; that is, since the veneer sheet cut off from the log is limp and has a lot of cracks formed at the time of cutting operation, it easily buckles when worked on by the cord embedding knife and the cracks in the sheet prevent the continuous forming of an elongated cut therein.

SUMMARY OF THE INVENTION

It is therefore an object of the present invention to provide a veneer lathe in which a cord embedding knife is disposed such that the veneer sheet cut off from the log will not buckle while the cord embedded in the elongated cut will not be dislocated at the time of veneer separation from the log.

In order to realize the above object, there is essentially provided a veneer lathe for turning a log to cut into veneer comprising means for supporting a log to permit a rotation about its axis in a predetermined direction; a veneer cutting knife having a straight edge tangentially oriented relative to a log periphery and adapted to counteract the log rotation to cut off a veneer sheet from the log; a cord embedding knife having an edge extending in a plane intersecting said straight edge of the veneer cutting knife, said cord embedding knife being provided on a rake face side of the veneer cutting knife to cut into the log to form an elongated cut in the veneer sheet cut off from said log and to place a length of cord in said elongated cut; and means for restraining said length of cord firmly in the elongated cut, the edge of said cord embedding knife extending upstream of the edge of the veneer cutting knife thereby to cut into the log periphery whereas said cord restraining means is adapted to release the cord downstream of said edge of the veneer cutting knife.

DETAILED DESCRIPTION OF THE EMBODIMENTS

Figure 4:
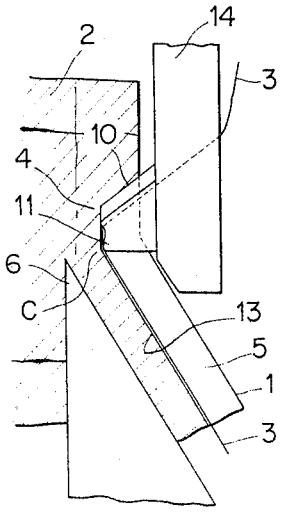
FIG. 4 shows in side elevation a veneer lathe according to the present invention.
Figure 5:
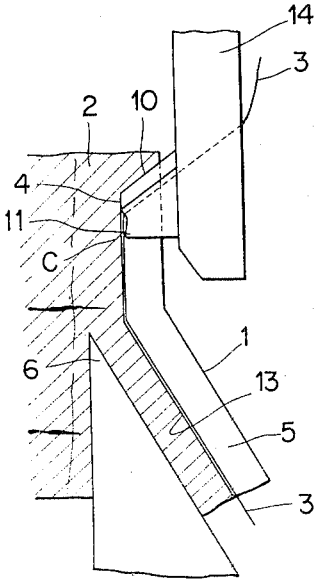
FIG. 5 PRIOR ART
FIG. 5 shows in side elevation a prior art veneer lathe.

The present invention will be further explained again in comparison with prior art referring to FIGS. 4 and 5.

Figure 6:
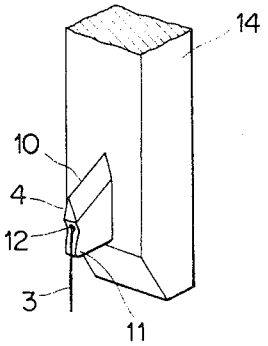
FIG. 6 is a perspective view of a cord embedding knife.

Both of the arrangements shown in FIGS. 4 and 5 include a cord embedding knife 4 indicated in a perspective view in FIG. 6 and which the present applicant's copending Japanese patent application entitled "Cord Embedding Apparatus", filed on Mar. 27, 1980, discloses.

Figure 7:
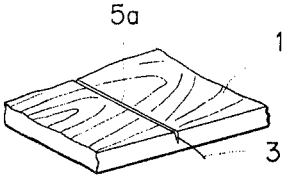
FIGS. 7–9 are perspective views of some examples of veneer sheets embedded with cords.
Figure 8:
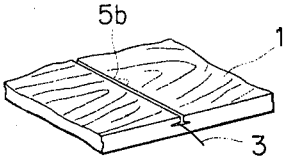
Figure 9:
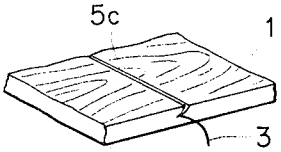

Although not shown in the drawings, a log 2 is supported by suitable means to ensure that the log 2 is permitted to rotate about its axis in a predetermined direction. Further, there is provided a veneer cutting knife 6 having a straight edge tangentially oriented relative to a log periphery and adapted to counteract the log rotation to cut off a veneer sheet from the log. The knife 4 is provided on a rake face side of the veneer cutting knife and is formed with a cutting edge 10. Further, the knife 4 is perforated to thread a length of cord and has a cord outlet opening 12 for the cord and protuberance 11 downstream of the opening so located as to permit a blade portion of the knife 4 downstream of the opening 12 to contact the cord 3 suitably. The knife 4 is fixedly retained by a holder 14. Said edge of the cord embedding knife 4 has an edge 10 extending in a plane perpendicular to and upstream of the straight edge of the veneer cutting knife 6. The cord embedding knife cuts into the log to form an elongated cut or slit in the log upstream of the edge of the knife 6 and place a length of cord in said elongated cut. The knife design in FIG. 6 is not limitative but only illustrative, however. FIGS. 7–9 show in perspective some examples of veneer sheets formed with cuts 5*a*–5*c* of different cross-sections and embedded with cords 3 in the cuts individually by other designs of the knife 4 applicable to the present invention. A knife which processes a veneer sheet as indicated in FIG. 8 is disclosed in the present applicant's copending Japanese Patent Application No. 53-137098. Regardless of the design choice, the cord embedding knife must be provided with means for restraining the cord 3 within the slit 5 in one mode or another thereby to locate the cord securely therein and release the cord downstream of the edge of the veneer cutting knife 6. Indeed, cord embedding knives hitherto proposed are furnished with such means without exception. For instance, the knife 4 in FIG. 4 or 5 restrains the cord 3 within the slit 5 not only with its opening 12 but with its blade formed with the protuberance 11. The knife 4 frees the cord 3 from the restraint substantially at a position indicated by a reference character C in FIG. 4 or 5. A matter of the utmost concern in the present invention is this position C where the cord 3 becomes substantially released, more specifically the relationship between the cord releasing position C and the position of a veneer cutting knife 6 which constitutes a major part of the veneer lathe. In FIG. 5, the conventional cord releasing position C of the knife 4 is located far upstream of the cutting edge of the veneer cutting knife 6 with respect to the direction of rotation of the log 2. In contrast, the cord releasing position C according to the present invention is located downstream of a position contained in a plane which extends perpendicular to the rake face of the knife 6 and contains the cutting edge of the knife 6 as shown in FIG. 4. When a tension is imparted to the cord 3 in FIG. 4 from the veneer sheet 1 cut from the log 2, the cord 3 is essentially prevented from lifting itself clear of the bottom 13 of the slit 5 toward the open end of the slit since, at a position adjacent to the log cutting knife 6, the cord 3 is restrained by the cord embedding knife 4 while maintaining its substantially straight position. With the prior art arrangement of FIG. 5 on the other hand, the cord 3 in the position adjacent to the log cutting knife 6 is not restrained by the cord embedding knife 4 and, moreover, it is bent within the slit 5. The result is the tendency of the cord 3 to rise as discussed with reference to FIG. 3. The bent position of the cord 3 enhances the lifting tendency because it increases or doubles even a small magnitude of pulling force to a significant magnitude of force. Such conditions of the cord 3 last throughout the reinforcing operation to render the cord embedment of the veneer lathe unstable.

Figure 1:
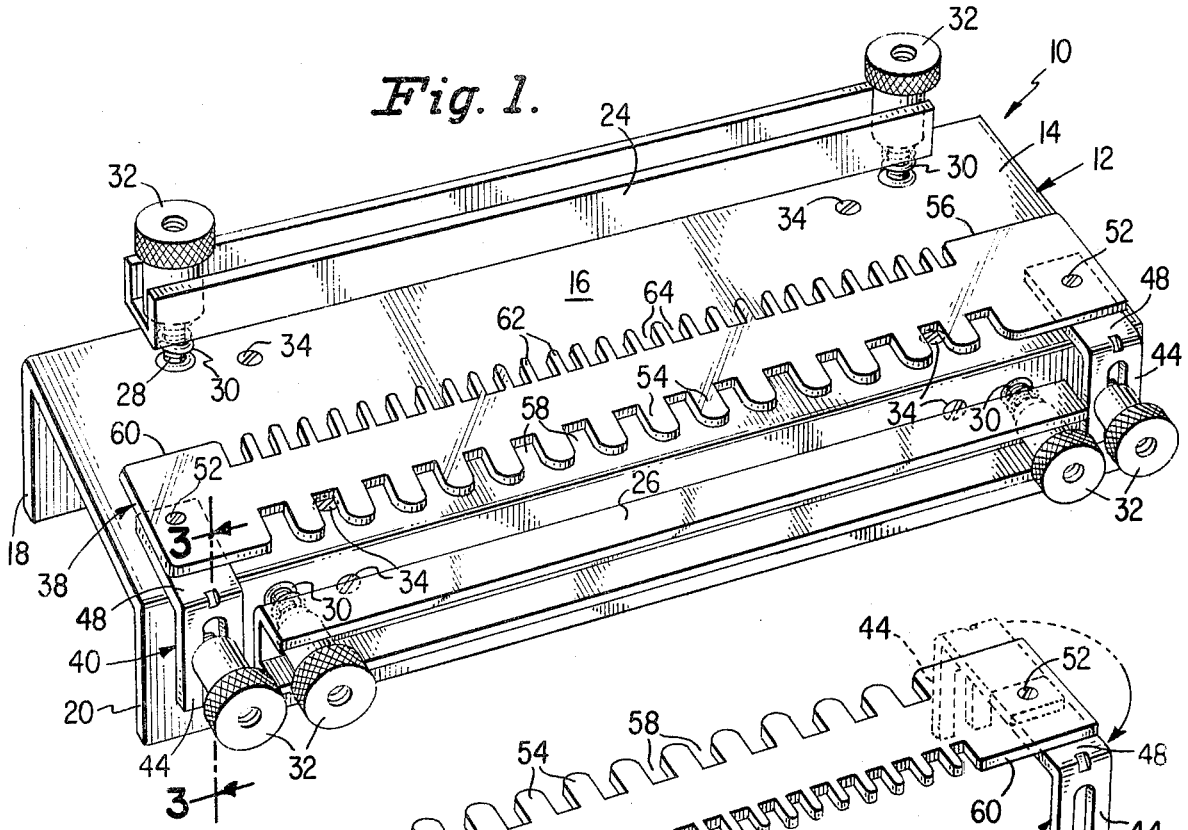
FIG. 1 is a side elevation of a prior art veneer lathe.
Figure 2:
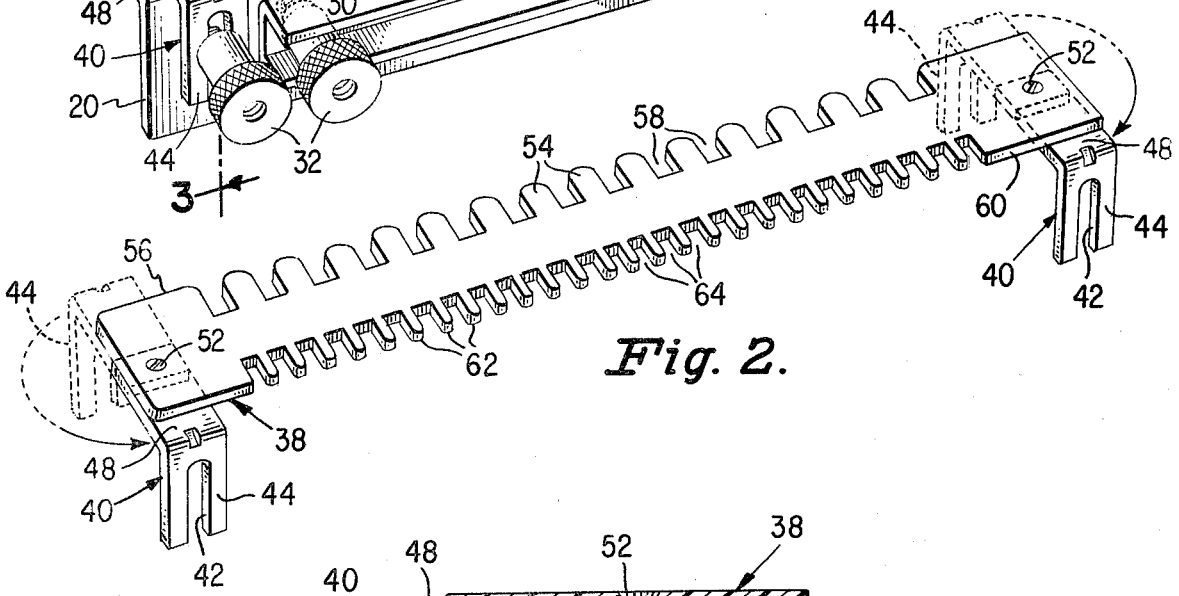
FIG. 2 is a section of a veneer sheet formed by the veneer lathe of FIG. 1.
Figure 3:
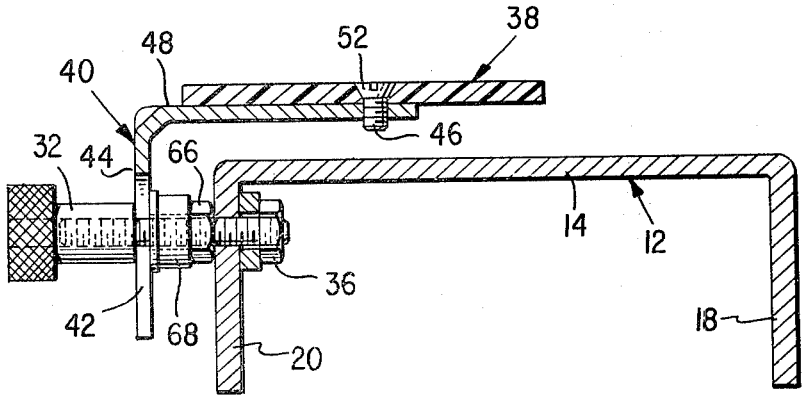
FIG. 3 is explanatory of operation of the same veneer lathe.
Figure 1:
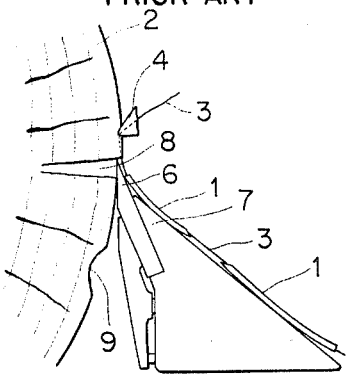
FIG. 1 PRIOR ART
Figure 3:
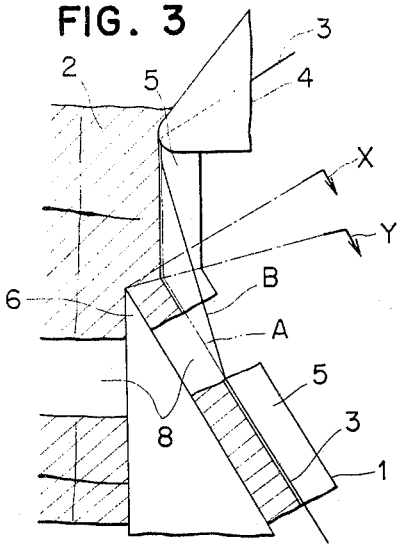
PRIOR ART FIG. 3
Figure 2:
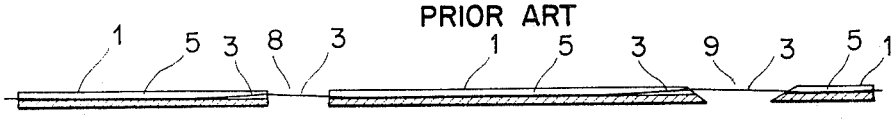
FIG. 2 PRIOR ART

As will now be appreciated, the gist of the present invention resides in that the cord embedding knife 4 cuts into the log upstream of the plane X while the restraint on the cord 3 is released at a position C downstream of a plane X shown in FIG. 3. This plane X is perpendicular to a rake face of the knife 6 and contains the tip of the knife edge therein. Denoted by the reference character Y in FIG. 3 is a plane normal to a plane which bisects the cutting angle of the veneer lathe defined by the log cutting knife 6. It is most desirable in principle that the cord releasing position C of the knife 4 be located downstream of the plane Y.

Figure 11:
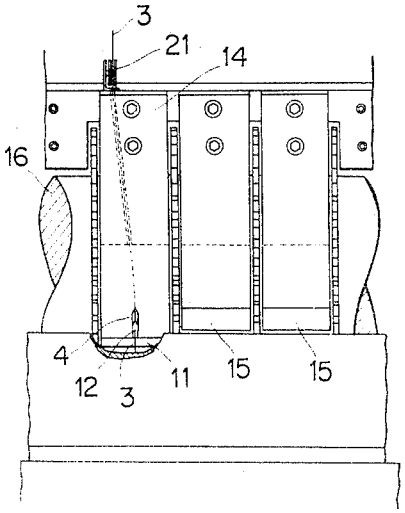
FIGS. 10 and 11 illustrate another embodiment of the present invention in a side elevational view and a front view, respectively.
Figure 10:
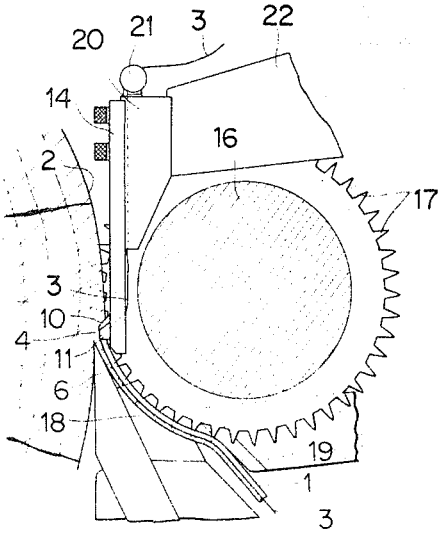

The principle of the present invention is applicable to a veneer lathe shown in FIGS. 10 and 11 which the present applicant developed and disclosed in copending Japanese Patent Application No. 53-122199 laid open to public inspection. In FIGS. 10 and 11, the veneer lathe includes a roller 16 having annular disc members mounted to the roller 16 and a plurality of piercing elements each of which is formed with a number of radially outwardly extending spaced piercing members 17 supported by the circumference of the disc members. The roller 16 is so located that the piercing members 17 cut into a part of the log 2 located immediately ahead of the veneer cutting knife 6 and a veneer sheet 1 freshly cut from the log 2 at the same time. Journalled to the machine frame, the roller 16 may be connected with a suitable drive source to supply the power necessary for log cutting or it may be an idle roller driven by the rotating log. The veneer sheet 1 cut off from the log 2 moves along a predetermined path guided by a lower guide member 18 which is cooperative with the piercing roller 16. A lever 19 is positioned downstream of the roller 16 and the guide 18 to separate the veneer sheet 1 from the piercing members 17 on each piercing element. Until the separating lever 19 removes the veneer sheet from the piercing members 17, the veneer sheet is prevented from imparting a concentrated pulling force or tension to the cord 3. More specifically, even when a hole or rotten spot of the lod reaches the log cutting knife 6, the piercing members 17 cutting into the resultant veneer sheet 1 prevents the pulling force due to the veneer sheet from being centered on the cord 3 in the slit, as long as the length of such defect is less than the distance between the cutting edge of the log cutting knife 6 and the separating position defined by the lever 19. Providing a veneer sheet with this kind of countermeasure against the phenomenon discussed will achieve a certain reasonable degree of success, but the effect is not free from a fundamental problem. For example, a defect in the log longer than the distance between the cutting edge of the knife 6 and the separating position 19 will still permit a pulling force to concentrate in the cord 3. It is preferable in this respect to incorporate the idea according to the present invention into the arrangement depicted in FIGS. 10 and 11. Thus, the cord embedding knife 4 in FIGS. 10 and 11 is so located as to release the cord 3 at a position downstream of the cutting edge of the veneer cutting knife 6 while maintaining the position of the edge of the knife 4 upstream of the edge of the knife 6. The veneer lathe shown in FIGS. 10 and 11 include at least one cord embedding knife 4 positioned on one side of the row of piercing members and mounted on respective holders 14 which are in turn mounted on a support 22 through brackets 20. A cord 3 is guided by a pulley 21 into a groove formed in each bracket 20 wherefrom it is passed through the cord supply opening 12 from the back of the cord embedding knife 4 to bury itself in a slit in the log 2. With this improved design, the cord 3 is not only embedded progressively in each slit 5 from the opening 12 upstream of the edge of the knife 6 but restrained by the protuberance 11 until it is freed from the restraint at the aforementioned position downstream of the cutting edge of the knife 6. The reference numeral 15 in FIG. 11 designates pressure bars.

Additionally, the piercing roller 16 forming part of the veneer lathe has a noteworthy relationship with the cord embedding knives 4. At opposite sides of each cord embedding knife 4, the rotatable roller 16 causes its piercing members 17 to pierce the log deeper than the knife 4. Hence, the piercing members 17 on the roller 16 positively and continuously support even an internal structural part of the log adjacent to the outer periphery in the vicinity of the knife 4 so that the knife 4 and its immediate neighborhood is safeguarded against clogging due to wood chips which may be separated from the log.

In summary, for a veneer lathe wherein a veneer sheet 1 cut from a log exerts a pulling force which tends to impart a tension to a cord 3, the present invention has been elaborated paying particular attention to a position C where the cord 3 is to become free from the restraint of the knife 4. In the embodiments shown and described, the cord embedding knife 4 is formed with a protuberance 11 downstream of a cord supply opening 12 which defines the cord releasing position C at a location downstream of a plane X substantially perpendicular to the rake face of a veneer cutting knife 6. Alternatively, a cord supply opening 12 may be relocated on the same face of the knife 4 such that the cord 3 becomes unrestrained at the relocated opening 12.

Conventional cord burying operations have been least stable at portions of a log which are in the greatest need of reinforcement. The present invention promotes stable embedment of a cord even in such portions while facilitating desired reinforcement when an adhesive is used in combination with a cord. Moreover, the construction according to the invention is very fundamental and simple so that an effect which is a key to the practical usability is afforded with an economical improvement.

What is claimed is:

1. A veneer lathe for turning a log to cut off veneer sheet from said log comprising means for supporting a log to permit said log to rotate about its axis in a predetermined direction;

a veneer cutting knife having a straight edge tangentially oriented relative to the periphery of said log and adapted to counteract the log rotation to cut off a veneer sheet from the log; and a cord embedding knife having an edge extending in a plane intersecting said straight edge of the veneer cutting knife, said cord embedding knife being provided on a rake face side of the veneer cutting knife to cut into the log upstream of the edge of said veneer cutting knife to form an elongated cut in the veneer sheet cut off from said log and to place a length of cord in said elongated cut, part of said knife extending downstream of said edge of the veneer cutting knife to restrain firmly said length of cord in the elongated cut.

2. A veneer lathe according to claim 1, further including a drive roller having at least one row of projecting edge means around its periphery, said projecting edge means being adapted to engage at least one of the log and the veneer sheet such that the log is driven to turn, the cord embedding knife and the cord restraining means being positioned on one side of said row of edge means.

3. A veneer lathe according to claim 2, wherein said projecting edge means includes a plurality of piercing members and an annular disc member mounted to the drive roller to support said piercing members at regular intervals therearound, each piercing member being adapted to pierce the log deeper than the depth of the elongated cut formed by the edge of the cord embedding knife.

4. A veneer lathe according to any one of the claims 1 to 3, wherein said cord embedding knife is positioned perpendicular to the veneer cutting knife.

5. A veneer lathe according to any one of the claims 1 to 3, wherein said cord embedding knife is perforated to thread said length of cord and has a cord cutlet opening.

6. A veneer lathe according to claim 5, wherein said cord restraining means includes a protuberance formed in the cord embedding knife downstream of said cord outlet opening.

* * * * *